United States Patent [19]

Graves

[11] 4,197,677

[45] Apr. 15, 1980

[54] BLADE SHARPENER

[75] Inventor: Louis N. Graves, Anoka, Minn.

[73] Assignee: Louis N. Graves Co., Inc., Anoka, Minn.

[21] Appl. No.: 896,936

[22] Filed: Apr. 17, 1978

[51] Int. Cl.[2] ..... B24D 15/06

[52] U.S. Cl. ..... 51/214

[58] Field of Search ..... 51/156, 205 WG, 211 R, 51/214, 212; 76/82, 84, 88

[56] References Cited

U.S. PATENT DOCUMENTS

| | | | |
|---|---|---|---|
| 269,409 | 12/1882 | Gowell | 51/211 R |
| 1,158,048 | 10/1915 | Hawks | 76/88 |
| 2,326,626 | 8/1943 | Duncan | 51/214 |
| 2,588,089 | 3/1952 | Custis | 51/211 R |
| 4,094,106 | 6/1978 | Harris | 51/214 |

FOREIGN PATENT DOCUMENTS

| | | | |
|---|---|---|---|
| 621715 | 4/1949 | United Kingdom | 76/84 |

*Primary Examiner*—Gary L. Smith

*Attorney, Agent, or Firm*—Burd, Bartz & Gutenkauf

[57] ABSTRACT

A blade sharpener includes a thin cylindrical sharpening rod made of a ceramic material which is loaded with a strong abrasive. This rod is equipped at each end with a conical guide-guard. Means is provided to position the rod with one hand so that the other hand can be used to draw the blade simultaneously along the rod and along the blade from near the blade handle toward the blade tip. The angle of the conical surfaces of the guide-guards with respect to the sharpening rod is the same as the desired angle of the blade to the rod while sharpening. The blade is initially positioned flat against the conical surface of one of the guide-guards to set the angle of the blade to the rod, and that angle is manually mantained during each sharpening stroke.

5 Claims, 4 Drawing Figures

BLADE SHARPENER

BACKGROUND OF THE INVENTION

Relatively thin rods of a ceramic material loaded with a strong abrasive have been used successfully to sharpen knives and other blades. See U.S. Pat. No. 3,894,362 to Louis N. Graves, granted in July of 1975, Class 51/211 R. In this sharpener, the cylindrical ceramic rods are supported in a horizontal base so that the angular relationship of the longitudinal axis of each rod to horizontal will be such that the desired angle of contact of the blade being sharpened with respect to each rod will be achieved when the vertical blade is held in a vertical plane at right angles to a vertical plane including the rods. This makes it imperative or at least very important that the operator sharpening a blade hold the blade in an exactly vertical plane at right angles to the plane of the rods on each sharpening stroke down the rods. This angular relationship is not always easy to maintain consistently throughout the sharpening process.

Furthermore, the direction of motion during sharpening of the blade is downwardly toward the base which supports the rods, and this can result in a scarring of the base and/or a dulling of the blade being sharpened whenever, as sometimes happens, there is an inadvertent overrun of the blade with respect to the base.

The use for sharpening of the thin cylindrical ceramic rods, loaded with an abrasive substance such as aluminum oxide, has been well accepted. However, some means of immediately and consistently setting the angle of the blade with respect to the rod prior to each sharpening stroke was needed; and some means of supporting the sharpening rod in a horizontal position so that more weight could be brought to bear on the blade as it moves along the length of the cylindrical sharpening rod was desired.

It has been well known for many years to sharpen "butcher's knives" using a "butcher's steel sharpener". These sharpeners include an elongated narrow cylindroid rod of steel sharpening material and a concentric handle at one end of the rod, with a guard between the handle and the sharpening rod to insure that the user not accidentally slice himself with the knife in the process of sharpening it.

To sharpen high carbon steel knives with this "butcher steel sharpener", the knife is to be drawn over one edge of the sharpener at a 15° to 20° angle on one side and then on the other. No means other than what the operator conceived to be a "15° to 20° angle" was provided. Therefore, the effectiveness of the sharpening varied from operator to operator, and customarily an experienced butcher would not allow an apprentice to sharpen his knives because the apprentice would inevitably affect the efficiency of the knives by sharpening them at something other than the accustomed angle.

To overcome these deficiencies in the prior art, the blade sharpeners of the present invention were developed.

The applicant has made no preliminary search of this invention, and neither the applicant nor his agents is aware of any prior art which anticipates the claims herein. Applicant and his agents know of no prior art closer than that discussed herein and cited in the aforementioned U.S. patent, namely U.S. Pat. No. 1,223,127 to Walker, granted in April of 1917, Class 51/211 R; and U.S. Pat. No. 2,674,072 to Lohmann, granted in April of 1954, Class 51/211 R.

BRIEF SUMMARY OF THE INVENTION

A relatively thin sharpening rod of a uniform cross sectional dimension throughout is constituted of abrasive material. For example, a cylindrical rod of ceramic material into which is dispersed an abrasive substance such as aluminum oxide has been found excellent for the purpose. At least one guide-guard is mounted to have a longitudinal axis coincident with the longitudinal axis of the sharpening rod at an end of the rod. The guide-guard is partially defined by a blade positioning surface which has an angular relationship with respect to the longitudinal axis of the guide-guard and rod which is identical with the predetermined desired angular relationship of a knife blade to be sharpened with respect to the longitudinal axis of the sharpening rod during the sharpening operation.

In the form of the invention as shown, this guide-guard is disclosed as being conical in shape, but one or a plurality of wedge-shaped members could serve as a guide-guard, for example.

In a first form of the invention as shown, two conical guide-guards are situated, one at either end of a cylindrical sharpening rod, and an elongated handle extends outwardly from one of the guide-guards in concentric relation to the longitudinal axis of the sharpening rod and the guide-guards. To use such a blade sharpener, the blade, for example a knife blade of a knife having a handle, is situated flat against the conical surface of the guide-guard farthest from the sharpener handle with the knife blade adjacent the knife handle in contact with the sharpening rod. The blade is then moved simultaneously along the sharpening rod and drawn along the blade proceeding from the knife handle toward the blade tip, until the tip of the blade comes off of the sharpening rod in adjacent relation to the guide-guard associated with the sharpener handle. The knife is then turned over, and the blade rested against the guide-guard nearest the handle with the edge of the blade nearest the knife handle in contact with the sharpening rod. The blade is maintained in the same angular relationship with respect to the rod axis and is moved along the rod and along the blade toward the tip in a similar manner. This operation is repeated on each side of the blade, maintaining the angle of the knife blade similar to that set by the guide-guards, until the knife is sufficiently sharpened.

In a second form of the invention, as shown, truncated conical guide-guards are fixedly mounted to a base member with an abrasive thin cylindrical sharpening rod extending between the guide-guards. A portion of the base member extends outwardly from one of the guide-guards to form a handle or a handle-like portion for steadying the blade sharpener when in use.

The blade to be sharpened is positioned alternately flat against each of the guide-guards and moved with respect to the abrasive rod in the same manner as set out in connection with the first form of the invention.

In the second form of the invention, the abrasive rod can be held in provided receptacles along the longitudinal axis of the guide-guards by a spring so that the abrasive rod can be rotated when it gets filled with metal deposits from the sharpening blade and can be removed from the guide-guards to be cleaned with ordinary kitchen cleanser to remove the metal deposits therefrom.

IN THE DRAWINGS

DESCRIPTION OF PREFERRED EMBODIMENTS

Figures 1, 2, 3, 4:
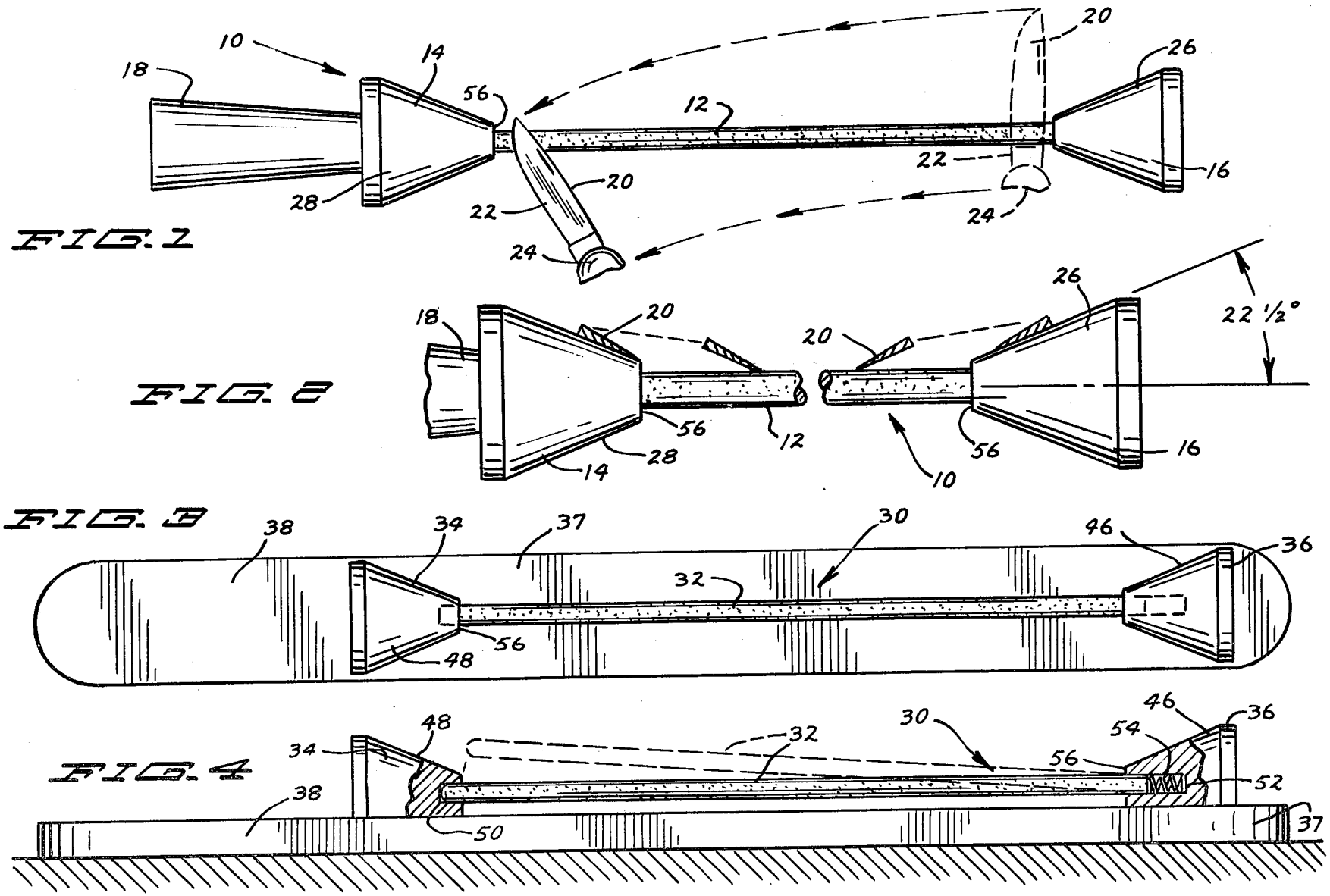
FIG. 1 is a top plan view of a blade sharpener made according to a first form of the present invention and showing a knife blade being sharpened thereon.
FIG. 2 is an enlarged fragmentary side elevational view of the blade sharpener as seen in FIG. 1 and showing the desired angular relationship of a blade being sharpened to a cylindrical sharpening rod of the sharpener.
FIG. 3 is a top plan view of a blade sharpener made according to a second form of the invention.
FIG. 4 is a side elevational view of the blade sharpener of FIG. 3 with parts in section and parts broken away.

In a first form of the invention as seen in FIGS. 1 and 2, a blade sharpener 10 includes an elongated, cylindrical sharpening rod 12 to which a pair of conical guide-guards 14 and 16 have been fixedly positioned. As shown, a handle 18 is concentric with and extends outwardly from guide-guard 14.

The conical axes of the guide-guards 14 and 16 are concentric with the axis of the sharpening rod 12; and, as shown, the conical surfaces of the guide-guards lie at an angle of 22½° with respect to the axis of the sharpening rod. This angle has been found to be a good typical or average angle for use by usual purchasers of blade sharpeners. However, should a particular angle be better for use in a particular situation or trade, blade sharpeners having guide-guards with such a preferred angle can be produced. For example, to comply with the more usual standards in the meat cutting trade, the angle of the conical surface to the longitudinal axis of the cones could be constituted as perhaps somewhere between 15° and 20°.

The sharpener of the first form of the invention can either be held freely in one hand, for example say the left hand, or it can be laid down against a horizontal surface and held in one hand, say for example the left hand. In either case, a blade to be sharpened, for example knife blade 20 of a knife 22 having a handle 24 can be positioned as seen in FIG. 2 and in dotted lines in FIG. 1 with the blade flat against a conical guide surface 26 of the guide-guard 16 and with the cutting edge of the blade 20 nearest the knife handle 24 in contact with the sharpening rod 12. Holding the knife to position the blade 20 firmly against the sharpening rod 12, but always maintaining the angle set by the conical surface 26 of the guide-guard 16, the blade is moved in direction toward the guide-guard 14 and simultaneously is moved from position with the knife edge adjacent the handle touching the rod toward position where the tip of the knife blade will be touching the rod.

After this sharpening stroke has been completed, with the knife 22 and the knife blade 20 moving past the position as seen in full lines in FIG. 1, for example, the knife handle 24 will be used to turn the knife over and the knife blade 20 will be positioned as seen in FIG. 2 in cross section and in contact with a conical guide surface 28 of the guide-guard 14 and with the portion of the knife blade adjacent the handle 24 in contact with the sharpening rod 12. A sharpening stroke will then be made maintaining the blade angle as set by the conical surface as the knife blade moves along the sharpening rod and simultaneously from position in contact with the cutting edge adjacent the handle toward the tip of the blade.

This procedure is repeated until the blade is suitably sharpened.

In the second form of the invention as seen in FIGS. 3 and 4, a blade sharpener 30 includes an elongated, cylindrical sharpening rod 32 fixedly but removably mounted in concentric relationship to a guide-guard 34 and a guide-guard 36. Guide-guard 34 is defined by a part conical guide surface 48 and guide-guard 36 is partially defined by a part conical guide surface 46; but each of the guide-guards is fixedly mounted with respect to a flat base 37. A portion of the base 37 extending to the left of the guide-guard 34 as seen in FIGS. 3 and 4 is designated as a holding or handle portion 38.

As seen in FIG. 4, the sharpening rod 32 is positioned in the guide-guards 34 and 36 in provided cylindrical mutually aligned receptacles 50 and 52 respectively. A compression coil spring 54 is situated in the receptacle 52, and normally holds the sharpening rod 32 against the far end of the receptacle 50 in the guide-guard 34.

As the sharpening rod 32 collects metal deposits during the sharpening process, it can be rotated with respect to the guide-guards to bring new surfaces into contact with the blades being sharpened. As seen in dotted lines in FIG. 4, the sharpening rod can be used to compress the spring 54 so that the sharpening rod can be removed from the guide-guards 34 and 36 for the purpose of being scrubbed with cleanser to remove the metal deposits therefrom.

If desired, the blade sharpener 30 of the second form of the invention can be used in the same manner as described in connection with the first form of the invention simply by grasping the handle portion 38 with one hand, for example the left hand, and holding the entire blade sharpener in the air while the blade to be sharpened is brought into contact with it in the manner described in connection with that first form of the invention.

However, the base 37 forms a good horizontal surface so that the blade sharpener 30 can be supported on a table or the like during the sharpening process. The blade to be sharpened will be laid against the conical guide surface 46 of the guide-guard 36 and in contact with the sharpening rod 32 with the axis of the blade of the knife being substantially horizontal. The positioning of the parts will be as pictured on the right-hand side of FIG. 2. The knife will then be maintained in this angular alignment with respect to the sharpening rod 32, will be moved along the sharpening rod and simultaneously will be moved from rod contact of the cutting edge adjacent the handle of the knife to rod contact of the cutting edge adjacent the tip in the identical manner described in the first form of the invention.

The knife will then be turned over, and the blade positioned as seen to the left in FIG. 2 in connection with the first form of the invention, and the procedure repeated. This procedure will be repeated until the knife is suitably sharpened.

It has been suggested above, for clarity of illustration only, that the blade sharpener by handled by the left hand while the blade to be sharpened is handled with the right hand. Some kitchen tools and shop tools come in either left-handed or right-handed form. For example, scissors. The blade sharpener of the present invention, however, can be used with equal effectiveness when handled either by the right or the left hand with the blade to be sharpened handled by either the left or the right hand.

It is possible to constitute the guide-guards 14,16, 34 and 36 in such a manner that the conical guide surfaces 26,28, 46 and 48 come right down to the outer cylindrical surface of the sharpening rods 12 and 32. However, in the form of the invention as shown, these guide-guards end in a plane at right angles to the longitudinal axis of the sharpening rods so that there is a disc-shaped guide-guard end surface 56 adjacent each of the outermost ends of each of the sharpening rods 12 and 32. This flat end surface 56 serves as a guard to limit the movement of the cutting edge of the blade in direction up the opposite guide-guard should too long a sharpening stroke be accidentally applied.

I claim:

1. A blade sharpener for sharpening the cutting edge of a blade to have a predetermined acute angular relationship to the nominal plane of the blade, said sharpener including:

(A) a relatively thin, cylindrical elongated sharpening rod;

(B) a pair of guide-guards fixedly positioned with respect to outer ends of said rod, said guide-guards each being partially defined by a conical guide surface in concentric relation to the longitudinal axis of said sharpening rod, said guide surfaces having the same angular relationship to the longitudinal axis of the rod as the predetermined desired relationship between a sharpened blade cutting edge to the nominal plane of the blade, said guide-guards each being further partially defined by a guard surface lying in a plane at right angles to the longitudinal axis of the sharpening rod, said guard surface defining the junction point of said rod and said guide-guard, the outer periphery of said guard surface terminating outwardly of the outer periphery of said sharpening rod; and (C) handle means for positioning the sharpener during use.

2. The blade sharpener of claim 1 wherein the handle means is constituted as an elongated handle extending concentrically outwardly from one of the guide-guards in direction opposite the sharpening rod.

3. The blade sharpener of claim 1; a base; and wherein the guide-guards are each fixedly positioned with respect to said base.

4. A blade sharpener for sharpening the cutting edge of a blade to have a predetermined acute angular relationship to the nominal plane of the blade, said sharpener including:

(A) a base;

(B) a relatively thin, cylindrical elongated sharpening rod;

(C) a pair of guide-guards each fixedly positioned with respect to an outer end of said rod and each fixedly positioned with respect to said base;

(D) said guide-guards each being partially defined by a conical guide surface in concentric relation to the longitudinal axis of said sharpening rod, said guide surfaces having the same angular relationship to the longitudinal axis of the rod as the predetermined desired relationship between a sharpened blade cutting edge to the nominal plane of the blade;

(E) the guide-guards each being provided with a cylindrical rod receptacle concentric with said guide surfaces and facing and mutually aligned with the other rod receptacle, said rod being rotatably mounted with respect to the guide-guards in said aligned cylindrical receptacles; and (F) handle means for positioning the sharpener during use.

5. The blade sharpener of claim 4 wherein a compression coil spring located in one of said guide-guard receptacles urges said rod in direction toward the other guide-guard; and wherein the length of the guide-guard and the depth of the receptacles is such that the rod can be removed from the guide-guards by compressing the spring to allow the rod to clear the opposite guide-guard.

* * * * *